US005602093A

United States Patent [19]

Haerer et al.

[11] Patent Number: 5,602,093

[45] Date of Patent: Feb. 11, 1997

[54] DISHWASHING MACHINE RINSE AIDS CONTAINING APG, ALKYL POLYGLYCOL ETHER AND ORGANIC CARBOXYLIC ACID

[75] Inventors: Juergen Haerer; Theodor Altenschoepfer, both of Duesseldorf; Peter Jeschke, Neuss; Christian Nitsch, Duesseldorf, all of Germany

[73] Assignee: Henkel Kommanditgesellschaft auf Aktien, Duesseldorf, Germany

[21] Appl. No.: 416,684

[22] PCT Filed: Sep. 28, 1993

[86] PCT No.: PCT/EP93/02632

§ 371 Date: Apr. 7, 1995

§ 102(e) Date: Apr. 7, 1995

[87] PCT Pub. No.: WO94/07977

PCT Pub. Date: Apr. 14, 1994

[30] Foreign Application Priority Data

Oct. 7, 1992 [DE] Germany ..... 42 33 699.6

[51] Int. Cl.[6] ..... C11D 3/22; C11D 1/72; C11D 3/20

[52] U.S. Cl. ..... 510/514; 510/422; 510/434; 510/470; 510/477; 510/506

[58] Field of Search ..... 252/174.21, 174.17, 252/174.19, 173, DIG. 14, DIG. 10; 510/514, 422, 434, 470, 477, 506

[56] References Cited

U.S. PATENT DOCUMENTS

| | | | |
|---|---|---|---|
| 3,481,881 | 12/1969 | Wedell | 510/514 |
| 3,592,774 | 7/1971 | Altenschöpfer | 510/514 |
| 4,187,121 | 2/1980 | Herold et al. | 510/514 |
| 4,548,744 | 10/1985 | Connor | 252/548 |
| 4,698,181 | 10/1987 | Lewis | 252/527 |
| 4,711,730 | 12/1987 | Gosselink et al. | 252/8.75 |
| 4,721,580 | 1/1988 | Gosselink | 252/90 |
| 4,770,815 | 9/1988 | Baker et al. | 252/542 |
| 4,834,903 | 5/1989 | Roth et al. | 252/174.17 |
| 4,913,828 | 4/1990 | Caswell et al. | 252/88 |
| 5,102,574 | 4/1992 | Russell et al. | 252/174.21 |
| 5,174,927 | 12/1992 | Honsa | 252/543 |
| 5,223,179 | 6/1993 | Connor et al. | 252/548 |
| 5,422,030 | 6/1995 | Panandiker et al. | 252/135 |

FOREIGN PATENT DOCUMENTS

| | | |
|---|---|---|
| 432836A2 | 6/1991 | European Pat. Off. . |
| 0432836 | 6/1991 | European Pat. Off. . |
| 1628652 | 2/1972 | Germany . |
| 3708330 | 9/1988 | Germany . |
| 8809369 | 12/1988 | WIPO . |

*Primary Examiner*—Ardith Hertzog
*Attorney, Agent, or Firm*—Wayne C. Jaeschke; John E. Drach; Henry E. Millson, Jr.

[57] ABSTRACT

Rinse aids for dishwashing machines comprising (1) an alkyl polyglycoside, (2) an alkyl polyglycol ether, and (3) an organic carboxylic acid wherein the rinse aid is substantially free from foam inhibitors and thickeners.

13 Claims, No Drawings

DISHWASHING MACHINE RINSE AIDS CONTAINING APG, ALKYL POLYGLYCOL ETHER AND ORGANIC CARBOXYLIC ACID

BACKGROUND OF THE INVENTION

International patent application WO 88/09369 describes water-based liquid detergents for dishwashing machines which contain 0.5% to 20% by weight of a mixture of alkyl polyglycosides corresponding to the formula R—O—$(Z)_x$H, where R=$C_{8-16}$ alkyl, Z=a glucose unit and x=1–3, preferably 1–2 and more particularly 1–1.4, and low-foaming nonionic surfactants corresponding to the formula $R_1$—O—$(EO)_n(PO)_m$H, where $R_1$=$C_{6-22}$ alkyl, n=1–40 and m=1–15, and 10% to 60% by weight of alkali metal citrates. Detergents such as these are unsuitable as rinse aids.

It is known that, where modern phosphate-free low-alkali detergents are used in dishwashing machines, lime and silicate coatings can be formed both on the washed articles and in the interior of the machine because the calcium binding capacity of such detergents is lower than that of conventional phosphate-containing products. Troublesome lime and silicate coatings are formed in particular when the rinsing water of the dishwashing machine is unsoftened or insufficiently softened and a water hardness of 4°dH is exceeded. In cases such as these, lime and silicate coatings can be effectively avoided by the introduction of citric acid into the final rinse cycle via the rinse aid. However, since the quantities of rinse aid normally added during the final rinse cycle are very small (3 ml to 6 ml), the citric acid content in rinse aid formulations intended to guarantee the effective inhibition of bloom has to be relatively high to achieve an adequate acid or complexing capacity. High citric acid contents support the effect of phosphate substitutes and guarantee spotless dishes.

European patent application 432 836 (Unilever) describes rinse aid formulations for dishwashing machines which contain only one surfactant selected from alkyl polyglycosides and, as further ingredients, foam inhibitors and thickeners. They do not contain any of the acid normally present in rinse aids.

Foam inhibitors are an essential ingredient of these formulations because alkyl polyglycosides are generally high-foaming and would cause unacceptable foaming of the described rinse aid formulations when used in a dishwashing machine. However, foam inhibitors are only effective if they are insoluble in the medium to be foam-inhibited. Accordingly, the alkyl polyglycoside solutions and the foam inhibitors are also immiscible with one another in the disclosed examples of rinse aids. Accordingly, two phases would exist unless a thickener—which provides for a certain homogenization—had been used to disperse them.

However, the latent inhomogeneity caused by the foam inhibitor remains a disadvantage of such a formulation. The foam inhibitor and surfactant solution of the rinse aid separate after only a short storage time, despite the content of thickener. A product such as this is of course unsuitable both for consumers of branded goods and for bulk consumers because the products required in both these cases are required to remain stable in storage over prolonged periods, but at least for one year. Accordingly, the only suitable formulations are single-phase formulations in which all the ingredients are homogeneously dissolved and which not only remain stable in storage, but also do not separate during the heating and cooling phase of the rinse cycle, i.e. show phase stability at temperatures in the dishwashing machine of 0° to 65° C. The low temperature is necessary because warehouses are generally not heated in winter. Accordingly, temperatures around freezing point are entirely realistic. On the other hand, the known products are so viscous—as long as they are homogeneous—that they cannot be poured in through the rinse aid dispenser of a domestic dishwashing machine.

In addition, rinse aid formulations containing only alkyl polyglycosides as their surfactant component do not wet plastic articles sufficiently, if at all, so that the clear rinse or clear drying effect is unsatisfactory in their case.

Today, only those formulation ingredients which are totally biodegradable under detergent legislation may be used in detergents, including rinse aid formulations. Accordingly, the problem addressed by the present invention was to find an ecologically and toxicologically satisfactory formulation which would be equivalent in its performance properties to commercial rinse aids and which would not have any of the disadvantages mentioned above.

DESCRIPTION OF PREFERRED EMBODIMENTS

It has surprisingly been found that mixtures of alkyl polyglycosides and alkyl polyglycol ethers or mixtures of alkyl polyglycosides and modified alkyl polyglycol ethers (end-capped fatty alcohol ethoxylates) or mixtures of alkyl polyglycosides, alkyl polyglycol ethers and modified alkyl polyglycol ethers with organic carboxylic acids do not have any of the disadvantages mentioned above, but fully satisfy the requirements which a commercial product is expected to meet both in regard to biological degradation and in regard to performance properties.

Another advantage of the rinse aids according to the invention is that no other solubilizer—which would normally be inert and therefore ineffective in terms of drying and the clear rinse effect, such as sodium cumeme sulfonate or ethanol or glucose sirup for example—is needed for the preparation of homogeneous solutions unless it is required in small quantities for the incorporation of dyes and/or fragrances.

Accordingly, the present invention relates to rinse aids for dishwashing machines based on alkyl polyglycosides corresponding to general formula $C_nH_{2n+1}$—O—$(C_6H_{10}O_5)_x$H, where n=8–16 and 1<x<3, characterized in that they additionally contain alkyl polyglycol ethers and/or modified alkyl polyglycol ethers and organic carboxylic acids. Short-chain alkyl polyglycosides ($C_8$–$C_{12}$), such as for example APF®225 (Henkel), Lutensol®GD 70 (BASF), are preferred by virtue of their low foaming. The quantity of alkyl polyglycoside in the rinse aids according to the invention is around 0.5% to 20% by weight, preferably 0.5% to 20% by weight, and more preferably around 1% to 10% by weight.

Suitable alkyl polyglycol ethers are compounds corresponding to the general formula $C_{12}$—$C_{18}$—O—$(EO)_x$H (EO =ethylene oxide), where x is an integer of 1 to 15 and preferably 2 to 10. They are used in quantities of around 1% to 20% by weight and preferably in quantities of around 3% to 10% by weight. Suitable alkyl polyglycol ethers are, for example, the Dehydols of Henkel KGaA, such as Dehydol® LS 2, Dehydol® LS 4, Dehydol® LS 5 and Dehydol® LT 2, Dehydol® LT 3 and Dehydol® LT 4. The Dehydol® products of the LS series are EO adducts with $C_{12-14}$ fatty alcohols while the Dehydol® products of the LT series are EO adducts with $C_{12-18}$ fatty alcohols. Dehydol® 100 ($C_{12-18}$ fatty alcohol·9 EO) and Dehydol® 980 ($C_{10-14}$ fatty alcohol·6 EO) are also suitable. Modified alkyl polyglycol ethers are, for example, alkyl polyglycol ethers end-capped by a butyl group such as, for example, Dehypon® LS 104, Dehypon® LT 104 and Dehypon® LT 054, products of Henkel KGaA.

The ratio by weight of alkyl polyglycosides to alkyl polyglycol ethers is of the order of 3:1 to 1:1.5 and preferably of the order of 2:1 to 1.5:1.

Suitable organic carboxylic acids are aliphatic hydroxydicarboxylic and tricarboxylic acids, such as malic acid (monohydroxysuccinic acid), tartaric acid (dihydroxysuccinic acid); saturated aliphatic dicarboxylic acids, such as oxalic acid, malonic acid, succinic acid, glutaric acid, adipic acid; gluconic acid (hexane pentahydroxy-1-carboxylic acid), but preferably water-free citric acid. They are used in quantities of around 1% to 50% by weight and preferably in quantities of around 1% to 30% by weight.

EXAMPLES

Performance testing of the rinse aid formulations:

I. Testing of the foaming behavior of the rinse aid formulations:

The foam generation of the rinse aid was determined by means of a circulation pressure measuring instrument. The rinse aid (3 ml) was introduced by hand into the final rinse cycle at 50° C. Foaming is scored as follows:

0 points=no foaming
1 point=slight foaming
2 points=medium foaming (still acceptable)
3 points=intensive foaming II. Drying:

15 Minutes after completion of the wash program, the door of the dishwashing machine was fully opened. After 5 minutes, drying was determined by counting the number of remaining drops on the articles mentioned below.

Scoring:

0 points=more than 5 drops
1 point=5 drops
2 points=4 drops
3 points=3 drops
4 points=2 drops
5 points=1 drop
6 points=0 drops (optimal drying)

III. Clear rinse effect:

After drying had been evaluated, the articles were left to cool for 30 minutes outside the dishwashing machine and then visually inspected under illumination in a black box. The dried residual drops, streaks, coatings, hazy films etc. remaining on the dishes and cutlery were evaluated.

Scoring:

0 points=poor clear rinse effect
8 points=optimal clear rinse effect

Performance tests II and III were carried out with softened water in a Bauknecht GSF 1162 dishwashing machine. The normal 65° C. program was selected. 40 ml of Somat® detergent (Henkel KGaA) were introduced into the wash cycle. The quantity of rinse aid (with the composition shown in Table 1) was 3 ml and was introduced by hand into the final rinse cycle at 50° C. The salt load of the water was between 600 and 700 mg/l. Three rinse cycles were carried out for each rinse aid formulation.

The following articles were used to evaluate drying and the clear rinse effect:

6 "Nekar Becher" glasses (Schott-Zwiesel)
3 "Brasilia" stainless steel knives (EMF)
3 white china plates (Arzberg)
3 red "Valon-Eβteller" plastic plates (Haβmann)

In every case, the rinse aids according to the invention were compared with those according to EP 432 836 and with an alkyl-polyglycoside-free formulation.

APG® 225: alkyl polyglycoside (Henkel KGaA); alkyl chains n=$C_{8-10}$, x=1.6
APG® 600: alkyl polyglycoside (Henkel KGaA); alkyl chains n=$C_{12-14}$, x=1.4
Lutensol® GD 70: alkyl polyglycoside (BASF)
Dehypon® DE 2429: foam inhibitor (Henkel KGaA), long-chain ketone dispersed in a branched fatty alcohol
Keltrol® F: thickener: high molecular weight polysaccharide
Kelzan® S: xanthan gum
A–D: prior art
1–4: comparison formulations
5–11: comparison formulations
DDWM: domestic dishwashing machine IV. Bloom-inhibiting effect of the rinse-aid formulations:

The bloom-inhibiting effect of the rinse-aid formulations according to the invention was tested under the following conditions:

Commercial phosphate-free, low-alkali detergents (Calgonit® Milde Kraft/Benckiser, Sun® Progress/Lever, Somat® 2000/Henkel) were used in the wash cycle under hard water conditions (16° dH) without an adequate water softener. Lime coatings and lime spots were formed on the articles and in the interior of the dishwashing machine, being reduced or eliminated by the rinse aids according to the invention in the following final wash cycle. The following test conditions were selected:

Dishwashing machine: Bosch S712
Program: normal 65° C. program
Water: hard 16° dH (Düsseldorf municipal water)
Rinse aid dosage: 3 ml
Detergent dosage: 20 ml The coatings remaining after the final rinse cycle were evaluated on the following points scale:

0 points=no coatings
10 points=heavy coatings

TABLE 1

| Formulation | 1 | 2 | 3 | 4 | 5 | 6 | 7 | 8 | 9 | 10 | 11 | A | B | C | D |
|---|---|---|---|---|---|---|---|---|---|---|---|---|---|---|---|
| APG ® 225*) | 15.0 | 15.0 | 15.0 | 15.0 | 8.0 | 8.0 | 8.0 | 8.0 | 8.0 | 8.0 | 8.0 | — | — | — | — |
| APG ® 600*) | — | — | — | — | — | — | — | — | — | — | — | — | 15.0 | 10.0 | 10.0 |
| $C_{12-18}$ alkyl + 3 EO | — | — | — | — | 6.0 | 6.0 | 6.0 | — | — | — | — | — | — | — | — |
| $C_{12-18}$ alkyl + 4 EO | — | — | — | — | — | — | — | 6.0 | — | — | 7.0 | — | — | — | — |
| $C_{12-14}$ alkyl + 5 EO | — | — | — | — | — | — | — | — | 6.0 | — | — | — | — | — | — |
| $C_{12-14}$ alkyl + 7 EO | — | — | — | — | — | — | — | — | — | 6.0 | — | — | — | — | — |
| Fatty alcohol + 9 EO n-butyl | — | — | — | — | — | — | — | — | — | — | 2.0 | — | — | — | — |
| Citric acid, | 3.0 | 30.0 | 35.0 | 40.0 | 30.0 | 40.0 | 50.0 | 3.0 | 3.0 | 3.0 | 3.0 | — | 3.0 | — | — |

TABLE 1-continued

| Formulation | 1 | 2 | 3 | 4 | 5 | 6 | 7 | 8 | 9 | 10 | 11 | A | B | C | D |
|---|---|---|---|---|---|---|---|---|---|---|---|---|---|---|---|
| water-free | | | | | | | | | | | | | | | |
| Lutensol ® GD 70 | — | — | — | — | — | — | — | — | — | — | — | 14.0 | — | — | — |
| Dehypon ® KE 2429 | — | — | — | — | — | — | — | — | — | — | — | 10.0 | — | 10.0 | 12.5 |
| Keltrol ® F | — | — | — | — | — | — | — | — | — | — | — | — | — | 0.5 | 0.5 |
| Kelzan ® S | — | — | — | — | — | — | — | — | — | — | — | 0.5 | — | — | — |
| Calcium stearate | — | — | — | — | — | — | — | — | — | — | — | — | — | — | 1.5 |
| Water | 82.0 | 55.0 | 50.0 | 45.0 | 56.0 | 46.0 | 36.0 | 83.0 | 83.0 | 83.0 | 80.0 | 75.5 | 82.0 | 79.5 | 75.5 |
| Foaming | 1 | 1 | 1 | 1 | 1 | 0 | 0 | 1 | 2 | 3 | 0 | 0 | 3 | 0 | 0 |

*)Active substance content

TABLE 2

| Drying of the crockery articles: clear rinse effect | | | | |
|---|---|---|---|---|
| Formulation | Glasses | Knives | China | Plastic |
| Commercial rinse aid*) | 4.4/5.8 | 4.0/7.0 | 5.2/8.0 | 5.0/5.5 |
| 1 | 1.5/5.2 | 3.4/6.3 | 3.8/7.1 | 0/0.3 |
| 2 | 0.9/5.1 | 3.0/7.0 | 3.6/7.0 | 0/1.2 |
| 3 | 0.7/4.8 | 3.4/7.1 | 3.8/7.0 | 0/1.1 |
| 4 | 1.4/4.2 | 3.3/7.1 | 4.3/7.4 | 0/1.1 |
| 5 | 3.4/6.1 | 3.3/6.7 | 4.6/7.6 | 2.8/6.0 |
| 6 | 3.7/6.4 | 3.3/6.1 | 4.4/7.4 | 3.1/5.9 |
| 7 | 4.3/6.8 | 4.3/6.1 | 4.6/7.6 | 2.5/5.8 |
| 8 | 3.3/6.4 | 3.8/6.7 | 4.5/7.3 | 3.3/6.0 |
| 9 | —/— | —/— | —/— | —/— |
| 10 | —/— | —/— | —/— | —/— |
| 11 | 4.8/5.8 | 4.4/6.3 | 5.0/8.0 | 5.0/7.2 |
| A | 1.4/4.9 | 2.5/6.4 | 3.1/1.8 | 0/1.8 |
| B | —/— | —/— | —/— | —/— |
| C | 2.7/5.0 | 2.7/6.1 | 4.0/3.6 | 0/3.6 |
| D | 3.3/5.7 | 2.8/5.7 | 3.6/4.5 | 0/4.5 |

*)Somat ® Citrus (Henkel KGaA)

The composition and foaming of formulations 1 to 11 according to the invention and comparison formulations A–D during the final rinse cycle are shown in Table 1. The foam-inhibited rinse aids formulated in accordance with EP 432 836 (formulations A, C, D) did not cause any foaming. Even formulations 1 to 4, which were formulated solely with APG® 225, led to only slight and tolerable foaming in the domestic dishwashing machine. In contrast to formulation 1, the non-foam-inhibited formulation containing APG 600® (B) led to intensive and unacceptable foaming. Formulations 5 to 11, which represent a combination of APG® 225 with alkyl polyglycol ethers differing in their ethylene oxide contents, foamed to different extents according to their EO content. Alkyl polyglycol ethers with EO contents below 7 were acceptable. With higher EO contents, intensive unacceptable foaming occurred during the final rinse cycle.

The drying effect of formulations 1 to 11 and A, C and D is shown in Table 2. It is apparent from this Table that the drying effect was at its best with rinse aid formulations containing a combination of APG and alkyl polyglycol ether or a combination of APG, alkyl polyglycol ethers and modified alkyl polyglycol ether. This performance advantage was particularly clear in the case of plastic plates.

The clear rinse effect of formulations 1 to 11 and A, C and D is shown in Table 2. The clear rinse effect of formulations 5 to 8 and 11, which contained APG® 225/alkyl polyglycol ether combinations or a combination of APG®, alkyl polyglycol ether and modified alkyl polyglycol ether, was distinctly better than that of formulations 1 to 4 containing only APG® 225 and formulations A, C and D.

The formulations according to the invention do not require a foam inhibitor or a thickener for stabilization or a solubilizer. In addition, they are equivalent in their clear rinse and clear drying effect to the commercial rinse aid. Compared with the formulations described in European patent application 432 836, the clear rinse and clear drying effect on plastic plates was significantly improved by the combination of APG® 225, alkyl polyglycol ethers and modified alkyl polyglycol ethers.

The bloom-inhibiting effects of various rinse aid formulations containing citric acid are shown in Table 3.

TABLE 3

| Formulation | Crockery articles |
|---|---|
| 8 | 8.5 |
| 5 | 4.2 |
| 6 | 3.0 |
| 7 | 1.3 |

Bloom formation is distinctly reduced by the rinse aid according to the invention containing citric acid. The bloom-inhibiting effect of the rinse aid formulation increases distinctly with increasing citric acid content. Formulation 8 contains 3% of citric acid, formulation 5 30%, formulation 6 40% and formulation 7 50%.

Phase stability

To determine phase stability, 40 g of rinse aid were slowly heated to 60° C. If no phase separation or clouding was observed during heating or at the final temperature, the rinse aid formulation had the required phase stability.

TABLE 4

| Formulation*) | Stability °C. | Solubilizer Yes/No | Foaming |
|---|---|---|---|
| APG ® 225 $C_{12-18}$ fatty alcohol · 5 EO | >60 | No | 2 |
| APG ® 225 $C_{12-18}$ fatty alcohol · 7 EO | >60 | No | 2 |
| APG ® 225 $C_{12-14}$ fatty alcohol · 3 EO | 60 | No | 1 |
| APG ® 225 $C_{12-14}$ fatty alcohol · 4 EO | 60 | No | 1 |

*)Formulation: 8% by weight APG ® 225 (active substance content) + 6% by weight fatty alcohol + EO (active substance content) + 3% by weight water-free citric acid + 83% by weight water.

Table 4 provides information on the thermal phase stability and the foaming of rinse aid formulations according to the invention in the final rinse cycle. It can be seen that the required performance properties, i.e. low foaming and phase stability at ≧60° C., were satisfied. Solubilizers, such as sodium cumene sulfonate or ethanol for example, were not required for phase stabilization.

What is claimed is:

1. A liquid rinse aid for dishwashing machines consisting essentially of: (1) about 0.5% to about 20% by weight of an alkyl polyglycoside of the formula $C_nH_{2n+1}$—O—$(C_6H_{10}O_5)_xH$, where n=8–16 and 1<x<3; (2) about 1 to about 20% by weight of an alkyl polyglycol ether of the formula $C_8$—$C_{18}$—O—$(EO)_y$—R where R=H or $C_mH_{2m+1}$ with m=1 to 4: and y=1 to 15 and; (3) about 1 to about 50% by weight of an organic carboxylic acid selected from the group consisting of aliphatic hydroxy dicarboxylic acids, hydroxy tricarboxylic acids and saturated aliphatic dicarboxylic acids, wherein the ratio by weight of (1) to (2) is from about 3:1 to about 1:1.5, add wherein said rinse aid is free from foam inhibitors and thickeners, is substantially free from other solubilizers, and is homogenous at a temperature in the range of from about 0° to about 65° C.

2. The rinse aid of claim 1 wherein component (1) is present in from about 1% to about 10% by weight, component (2) is present in from about 3 to about 10% by weight, and component (3) is present in from about 1 to about 30% by weight.

3. A method for the aftertreatment of the clean contents of an automatic dishwashing machine comprising treating said contents with the rinse aid of claim 2.

4. The rinse aid of claim 1 wherein in said alkyl polyglycoside n is 8–10 and x is about 1.6.

5. The rinse aid of claim 4 wherein the amount of is from about 0.5% to about 15% by weight.

6. The rinse aid of claim 4 wherein the amount of component (1) is from about 1% to about 10% by weight.

7. The rinse aid of claim 1 wherein the amount of component (2) is from about 3% to about 10% by weight.

8. The rinse aid of claim 1 wherein in component (2), y=2 to 10.

9. The rinse aid of claim 1 wherein said carboxylic acid is citric acid.

10. The rinse aid of claim 9 wherein the amount of citric acid is from about 1% to about 30% by weight.

11. The rinse aid of claim 1 wherein said ratio is from about 2:1 to about 1.5:1.

12. The rinse aid of claim 1 further consisting essentially of less than about 1% by weight of a fragrance.

13. A method for the aftertreatment of the clean contents of an automatic dishwashing machine comprising treating said contents with the rinse aid of claim 1.

* * * * *